US006315948B1

(12) United States Patent
Lenczowski et al.

(10) Patent No.: US 6,315,948 B1
(45) Date of Patent: Nov. 13, 2001

(54) WELDABLE ANTI-CORROSIVE ALUMINUM-MAGNESIUM ALLOY CONTAINING A HIGH AMOUNT OF MAGNESIUM, ESPECIALLY FOR USE IN AUTOMOBILES

(75) Inventors: Blanka Lenczowski, Neubiberg (DE); Viktor Yelagin, Moskau Russland (RU); Rainer Rauh, Jetzendorf (DE); Valeri Zakharov; Yuri Filatov, both of Moskau Russland (RU)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 09/530,067

(22) PCT Filed: Aug. 10, 1999

(86) PCT No.: PCT/DE99/02491

§ 371 Date: Oct. 17, 2000

§ 102(e) Date: Oct. 17, 2000

(87) PCT Pub. No.: WO00/11231

PCT Pub. Date: Mar. 2, 2000

(30) Foreign Application Priority Data

Aug. 21, 1998 (DE) ..... 198 38 015

(51) Int. Cl.[7] ..... C22C 21/06
(52) U.S. Cl. ..... 420/543; 420/553
(58) Field of Search ..... 420/542, 543, 420/544, 553; 148/440

(56) References Cited

U.S. PATENT DOCUMENTS

| | | | |
|---|---|---|---|
| 4,645,543 | 2/1987 | Watanabe et al. | 148/2 |
| 5,055,257 | 10/1991 | Chakrabarti et al. | 420/902 |
| 5,624,632 | 4/1997 | Baumann et al. | 420/544 |
| 6,056,835 * | 5/2000 | Miyake et al. | 148/415 |

FOREIGN PATENT DOCUMENTS

| | | |
|---|---|---|
| 2717827 | 9/1995 | (FR) . |
| 63179040 | 7/1988 | (JP) . |
| 63248593-A * | 10/1988 | (JP) . |

OTHER PUBLICATIONS

Patent Abstracts of Japan of JP 63–179040 Dated: Jul. 23, 1988.

Brockhaus der Naturwissenschaften und der Technik, p. 161 (1965) F.A. Brockhaus Wiesbaden.

Gschneider, Jr., K.A. "A critical Review of the Alloy Systems of the Rare Earth, Scandium and Yttrium Metals," in Rare Earth Alloys (1961) pp. XI & 12.

Kazakov, V.A., et al., "Aluminum Alloy for welding wire" *Chemical Abstracts,* vol. 84, No. 18 (1976).

Lukin, V.I., "Effect of Alloying Elements Sc, Mn and Zr on weldability of alloys of the Al–Mg–Sc–Mn–Zr system" *Welding International,* vol. 10, No. 12 (1996) pp. 987–989.

* cited by examiner

*Primary Examiner*—George Wyszomierski
*Assistant Examiner*—Janelle Combs-Morillo
(74) *Attorney, Agent, or Firm*—Ladas & Parry

(57) ABSTRACT

A weldable, high magnesium-content aluminum-magnesium alloy consisting essentially of at lest 5 to 6% by weight magnesium (Mg), 0.05 to 0.15% by weight zirconium (Zr), 0.7 to 1% by weight manganese (Mn), 0.01 to 0.2% by weight titanium (Ti), 0.005 to 0.5% by weight cerium (Ce), 0.05 to 0.5% by weight of one or more elements selected from the scandium group of the Periodic Table and/or terbium (Tb), wherein at least scandium (Sc) is included with or without terbium (Tb) and with or without 0.05 to 0.45% by weight of an element from the lanthanide series, the balance being aluminum (Al), and unavoidable contaminants not exceeding 0.2% by weight silicon (Si).

6 Claims, No Drawings

WELDABLE ANTI-CORROSIVE ALUMINUM-MAGNESIUM ALLOY CONTAINING A HIGH AMOUNT OF MAGNESIUM, ESPECIALLY FOR USE IN AUTOMOBILES

BACKGROUND OF THE INVENTION

The invention relates to a weldable, corrosion-resistant, high-magnesium content aluminum-magnesium alloy, which contains a ternary aluminum-scandium-zirconium phase as an essential component. Such an alloy is disclosed in U.S. Pat. No. 5,624,632, for application in aircraft due to its low density, high strength and corrosion resistance. Adding rare earth or rare earth-like elements generates dispersoids in the aluminum-magnesium alloy, which produce a higher strength and corrosion resistance. The aforesaid US patent is silent as regards the weldability of such an alloy.

SUMMARY OF THE INVENTION

An object of this invention is to provide a weldable, corrosion-resistant, high magnesium content aluminum-magnesium alloy, which is at least as good as the known alloy with respect to strength and corrosion resistance and exhibits a high recrystalization threshold and good weldability. This and further objects of the invention are achieved by a weldable, high magnesium-content aluminum-magnesium alloy consisting essentially of 5 to 6% by weight magnesium, 0.05 to 0.15% by weight zirconium, 0.7 to 1.0% by weight manganese, 0.01 to 0.2 by weight titanium, 0.005 to 0.5% by weight cerium, 0.05 to 0.5% by weight of at least one element selected from the group consisting of the scandium group of the Periodic Table, wherein at least scandium is present, the balance being aluminum, and unavoidable contaminants not exceeding 0.2% by weight silicon.

DETAILED DESCRIPTION

The alloy of the invention is particularly well-suited for use as body panels of automotive vehicles due to its weldability and strength, and the presence of titanium and cerium, which are not present in the known alloy. An alloy with a ratio of manganese to scandium of less than 2 exhibits particularly good corrosion resistance. Along with acting as a grain growth inhibitor, the titanium content (not present in the known alloy) helps to increase strength, since titanium can replace the zirconium in the ternary Al—Sc—Zr phase, wherein the solubility of titanium is lower than that of zirconium, however. The added cerium also helps increase strength, as well as the modulus of elasticity and thermal stability.

It has also been found that scandium can be replaced by terbium, at least within certain limits. However, more terbium than the amount of scandium being replaced must be added to achieve constant properties.

A particularly strong and corrosion-resistant alloy contains at least 0.15% by weight of scandium. One or more Lanthanide series elements are preferably added in amounts ranging from 0.05 to 0.35% by weight. The alloy tolerates silicon contamination of up to 0.2% by weight as the dynamic properties deteriorate above this level.

The alloy is also usable in the manufacture of rolled, extruded and forged parts of the body of an automotive vehicle.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A weldable, high magnesium-content aluminum-magnesium alloy consisting essentially of 5 to 6% by weight magnesium, 0.05 to 0.15% by weight zirconium, 0.7 to 1.0% by weight manganese, 0.01 to 0.2% by weight titanium, 0.05 to 0.5% by weight of at least one element selected from the group consisting of scandium and the lanthanide series, wherein at least scandium and 0.005 to 0.5% by weight cerium are present, the balance being aluminum, and unavoidable contaminants not exceeding 0.2% by weight silicon.

2. An aluminum-magnesium alloy as claimed in claim 1, wherein the ratio of manganese to scandium is less than 2.

3. An aluminum-magnesium alloy as claimed in claim 1, wherein at least 0.15% by weight of scandium is present in the alloy.

4. An aluminum-magnesium alloy as claimed in claim 1, wherein said element in the lanthanide series comprises terbium.

5. An aluminum-magnesium alloy as claimed in claim 1, wherein said element in the lanthanide series is neodymium, europium, gadolinium, dysprosium, holmium or erbium.

6. Rolled, extruded, welded or forged component of a motor vehicle consisting of an AlMg alloy according to claim 1.

* * * * *